US006096495A

United States Patent [19]

Kasai et al.

[11] Patent Number: 6,096,495

[45] Date of Patent: Aug. 1, 2000

[54] METHOD FOR PREPARING SILVER HALIDE EMULSION

[75] Inventors: Shigetami Kasai; Hisatake Okada, both of Hino, Japan

[73] Assignee: Konica Corporation

[21] Appl. No.: 09/113,935

[22] Filed: Jul. 10, 1998

[30] Foreign Application Priority Data

Jul. 15, 1997 [JP] Japan ..... 9-189678

[51] Int. Cl.[7] ..... G03C 1/015; G03C 1/035

[52] U.S. Cl. ..... 430/569; 430/567

[58] Field of Search ..... 430/569, 567

[56] References Cited

U.S. PATENT DOCUMENTS

| | | | |
|---|---|---|---|
| 5,104,786 | 4/1992 | Chronis et al. | 430/569 |
| 5,196,300 | 3/1993 | Urabe et al. | 430/568 |
| 5,250,403 | 10/1993 | Antoniades et al. | 430/505 |
| 5,380,641 | 1/1995 | Urabe et al. | 430/569 |
| 5,484,697 | 1/1996 | Mignot et al. | 430/569 |
| 5,750,326 | 5/1998 | Antoniades et al. | 430/568 |

OTHER PUBLICATIONS

European Search Report EP 98 11 3050.

*Primary Examiner*—Mark F. Huff
*Attorney, Agent, or Firm*—Jordan B. Bierman; Bierman, Muserlian and Lucas

[57] ABSTRACT

A method for preparing a silver halide emulsion is disclosed, comprising introducing a silver salt solution and a halide solution through separate introduction tubes, mixing the silver salt and halide solutions to react a silver salt and a halide to form silver halide grains and discharging a reaction mixture solution through a discharge tube by the use of a mixing apparatus in which the introduction tubes and the discharge conduit are linked together so that all center axes of the introduction and discharge tubes intersect at a single point, wherein the silver salt solution and the halide solution are independently introduced at a linear velocity of not less than 4.0 m/sec and a Reynolds number of not less than 3,000.

11 Claims, 5 Drawing Sheets

METHOD FOR PREPARING SILVER HALIDE EMULSION

FIELD OF THE INVENTION

The present invention relates to a silver halide tabular grain photographic emulsion superior in monodispersibility and preparation stability.

BACKGROUND OF THE INVENTION

Recently, with the spread of compact cameras and single-use cameras, there have been increased photographing opportunities by the use of a silver halide light sensitive photographic material (hereinafter, also referred simply to a photographic material). As a result, desire for enhancement of photographic performance of silver halide photographic materials has become strong and a higher level of photographic performance is desired. Introduction of Advanced Photo System resulted in an increase of enlarged prints so that development of silver halide grains, aiming at enhanced sensitivity and image quality, has become more important.

Of this development, the most basic and important technique is one for enhancing homogeneity of the grain size distribution, i.e., monodispersity of the silver halide emulsion. As is well recognized in the photographic art, silver halide grains of varying sizes require different optimal conditions for chemical sensitization, so that it is difficult to subject a silver halide emulsion comprised of the grains with both grain sizes, i.e., a polydispersed silver halide emulsion having a broad grain size distribution, to optimal chemical sensitization, often leading to increased fog density or insufficient chemical sensitization. The use of a monodispersed silver halide emulsion makes it easy to achieve optimum chemical sensitization and enables preparation of silver halide emulsions with a high sensitivity and a low fog density. Further,a characteristic curve with high contrast can also be expected.

Silver halide emulsions used in photographic materials can be prepared mainly by the so-called single jet method, in which an aqueous solution of an aqueous soluble silver salt such as silver nitrate is added to a reaction vessel containing a dispersing medium and a halide to allow both salts to react and grow grains, or by the so-called double jet method, in which the aqueous soluble silver salt and the halide are simultaneously added through separate nozzles into a reaction vessel containing a dispersing medium, and then allowed to react and grow grains. In cases where preparation is made by the single jet method, it is rather difficult to control the grain size distribution, the halide distribution within the grain or among the grains, and an internal disorder of the grain. Contrarily, with the double jet method, it is relatively easy to control them, as compared to the single jet method, however, it is limited in reduction of non-uniformity due to variations during reaction, or stagnation. JP-A 2-44335 (herein, the term, JP-A refers to unexamined published Japanese Patent Application) discloses a method of providing a pre-reaction vessel, in which ultra-fine grains as a source of solutes are formed while stirred at high speed and later introducing the thus-formed ultra-fine grains into the reaction vessel. In this method, however, at least the space necessary for stirring and a piping line necessary for introducing the solute-source grains to the reaction vessel from the pre-reaction room are needed, allowing the solute-source grains to grow while being retained therein.

To overcome the problems described above, JP-A 4-139441 discloses a preparation method by means of an apparatus in which a silver salt aqueous solution and a halide aqueous solution are introduced through separate routes to a spiral mixing nozzle to allow the solutions to be mixed and react. In this case, however, it was proved that both reaction solutions were insufficiently mixed, partly due to mixing without using a turbulent flow region, and the aspect ratio of the resulting silver halide grains was insufficient. Further, there was no teaching with respect to the grain size/grain size distribution or photographic performance.

The apparatus used in the invention is a branched type static mixing apparatus in which plural introduction tubes and a discharge tube are linked together. A double structure coaxial nozzle disclosed in JP-A 4-182636, a multiple coaxial nozzle disclosed in JP-A 4-139439 and a dual zone reaction apparatus disclosed in JP-A 8-328177 are distinct in the mixing mode from the apparatus according to the invention. JP-A 8-171156 discloses a preparation method of a silver halide emulsion, in which silver salt and halide solutions are simultaneously introduced to a high speed turbulent flow reaction zone, leading to improvements in the variation or transfer of the scale. It uses a stirring system consisting of a mixing head, which is different in the mixing mode from the apparatus according to the invention.

With regard to techniques of preparing monodispersed silver halide tabular grains, JP-A 1-213637 describes a technique for improving the sensitivity and graininess using monodispersed silver halide grains having two parallel twin planes; and JP-A 5-173268 and 6-202258 discloses the method for preparing a silver halide tabular grain emulsion with a narrow size distribution.

In response to the desire for further enhanced photographic performance of photographic materials on the market, however, there is desired a technique of achieving photographic performance exceeding that obtained by employing various techniques in silver halide tabular grain emulsions described above, in particular, superior photographic performance in the main photographic elements, such as sensitivity and graininess.

SUMMARY OF THE INVENTION

In view of the foregoing, it is an object of the present invention to provide a method for preparing a silver halide tabular grain emulsion which is monodispersed with respect to the grain size distribution, based on the equivalent circular diameter, and has a relatively high average aspect ratio.

The above object of the present invention can be accomplished by the following constitution:

(1) a method for preparing a silver halide emulsion, comprising introducing an aqueous silver salt solution and an aqueous halide solution through separate introduction tubes, mixing the silver salt and halide solutions to react a silver salt and a halide to form silver halide grains, and discharging a reaction mixture solution through a discharge tube, using a branched type static mixing apparatus in which the introduction tubes and a discharge tube are linked together so that all center axes of the tubes intersect at a single point, wherein the silver salt solution and the halide solution are independently introduced at a linear velocity of not less than 4.0 m/sec and at a Reynolds number of not less than 3,000;

(2) the method described in (1), wherein the Reynolds number is not less than 10,000;

(3) the method described in (1), wherein the linear velocity is not less than 5.0 m/sec.;

(4) the method described in (1), wherein the linear velocity in each of the introduction tubes is not less than 10.0 m/se and the linear velocity in the discharge tube is not less than 20 m/sec.;

(5) the method described in (1), wherein a difference in the inner diameter (or a cross-sectional area) between the introduction tubes is within 10%;

(6) the method described in (1), wherein a difference in the inner diameter (or a cross-sectional area) between the introduction tubes and the discharge tube is not more than 10%;

(7) the method described in (1), wherein the silver salt solution contains a silver salt of not more than 0.01 mol/l;

(8) the method described in (7), wherein a difference in a molar concentration between the silver salt aqueous solution and the halide aqueous solution is not more than 10%;

(9) the method described in (1), wherein the silver salt solution and the halide solution are each supplied through the introduction tubes by the use of a pump having a pulsating flow rate within ±2% of the average flow rate;

(10) the method described in (1), wherein at least 50% of the total number of the silver halide grains formed is accounted for by tabular grains having two parallel twin planes, the silver halide grains having an average grain size of not more than 0.05 $\mu$m and a variation coefficient of the grain size of not more than 20%;

(11) the method described in (1), wherein the silver halide grains formed are discharged through the discharge tube and then introduced into a reaction vessel to allow the silver halide grains to grow therein, and wherein the silver potential in the discharge tube is continuously measured and when variation of the silver potential reaches 2.0 mV or less, the silver halide grains which are discharged from the discharge tube, are introduced into the reaction vessel; and

(12) the method described in (11), wherein at least 50% of the total projected area of the silver halide grains which are grown in the reaction vessel is accounted for by monodisperse tabular grains having an aspect ratio of not less than 5, an average grain diameter of not less than 0.6 $\mu$m and a variation coefficient of grain size of not more than 20%.

DETAILED DESCRIPTION OF THE INVENTION

In a stirring apparatus using a conventional mixing vessel, generated nucleus grains circulate and return thereto, so that uniform nucleation cannot be achieved during the period of nucleation. Contrary to that, according to the invention, generated nucleus grains are immediately discharged through the discharge tube, enabling the nucleus grains to be generated in the stationary state.

An apparatus according to the invention will now be exemplarily explained by reference to FIG. 2. An aqueous silver salt solution and an aqueous halide solution are each introduced through separate tubes from inlet 1 and inlet 2 of the Y-type pipe, respectively. The solutions are substantially instantaneously mixed in a mixing zone and the silver salt solution contains a silver salt that reacts with a halide contained in the halise solution to form nucleus grains as a reaction product, and then the reaction product is immediately discharged from outlet 3. The nucleus grains discharged from the outlet 3 are further introduced into a ripening-growing vessel 4 and subjected to ripening and growth. The nucleus grains are further grown by adding silver salt and halide solutions to the vessel 4 by the double jet addition to form final silver halide grains.

Figure 1:
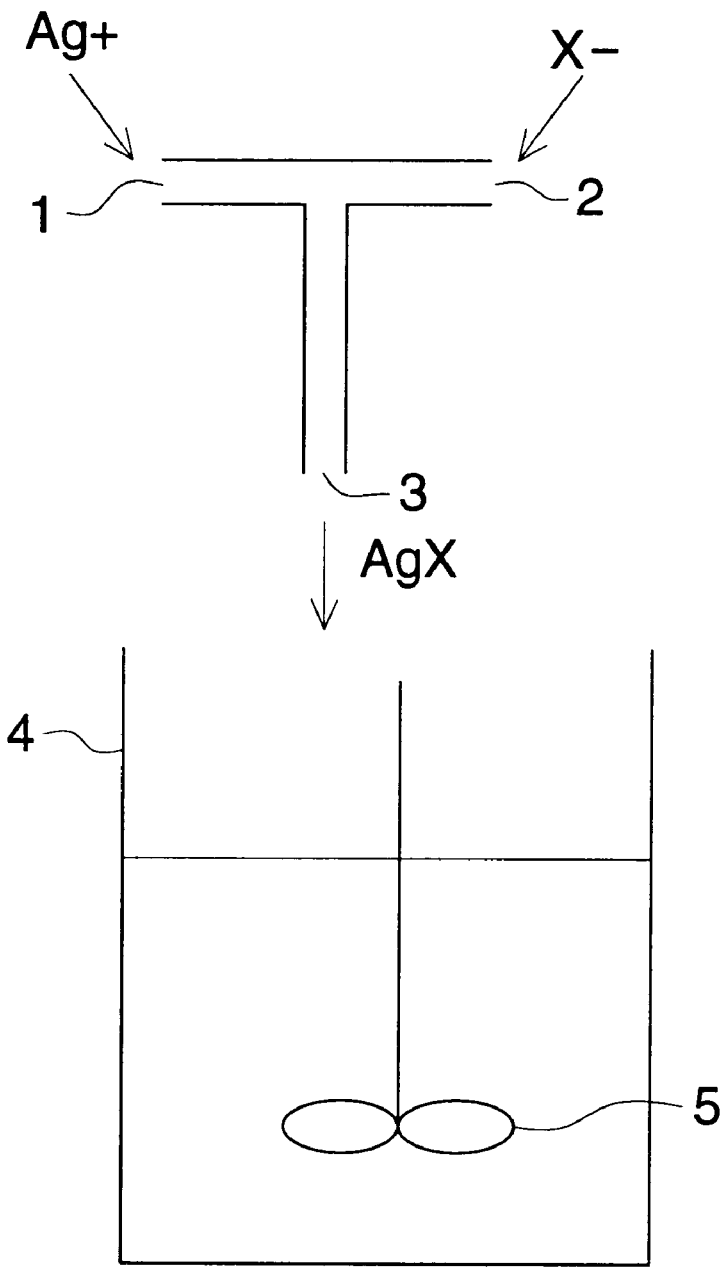
FIGS. 1 and 2 each show a schematic illustration of a mixing apparatus according to the present invention.
Figure 3A:
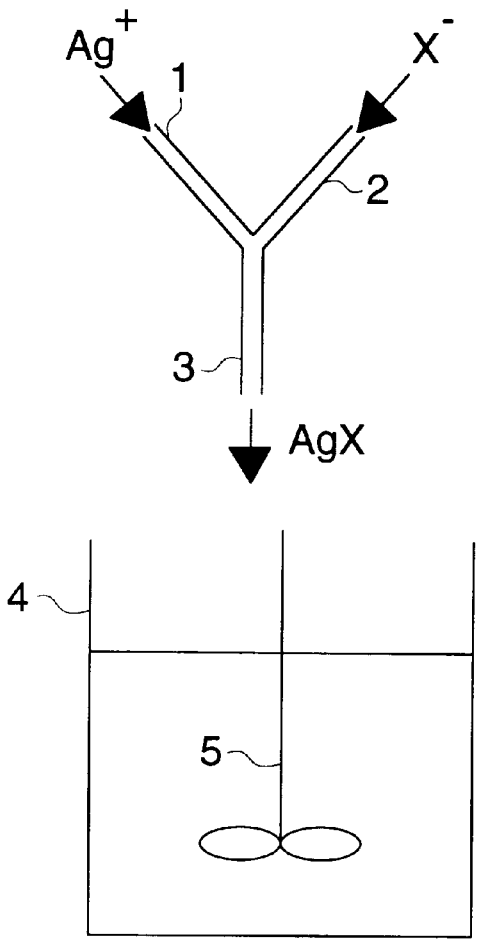
FIG. 3*a* illustrates a front view of a mixing apparatus according to the invention and FIG. 3*b* illustrates a side view thereof.
Figure 3B:
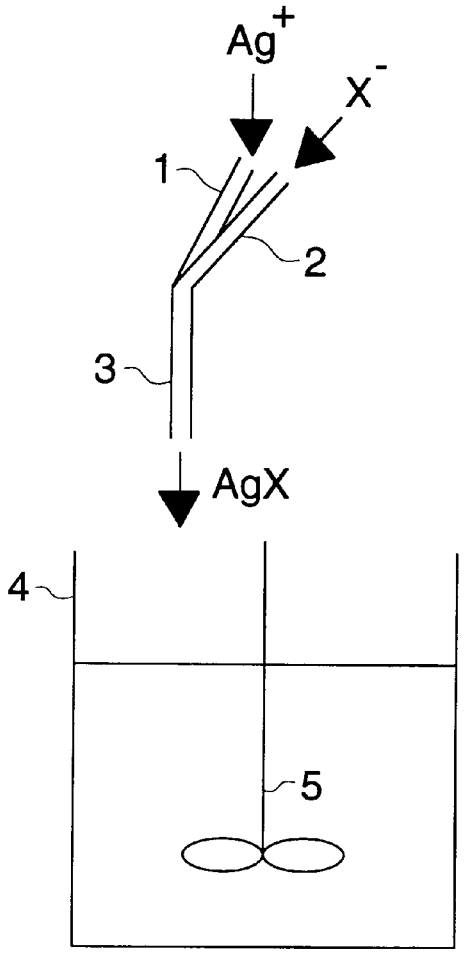
Figure 4A:
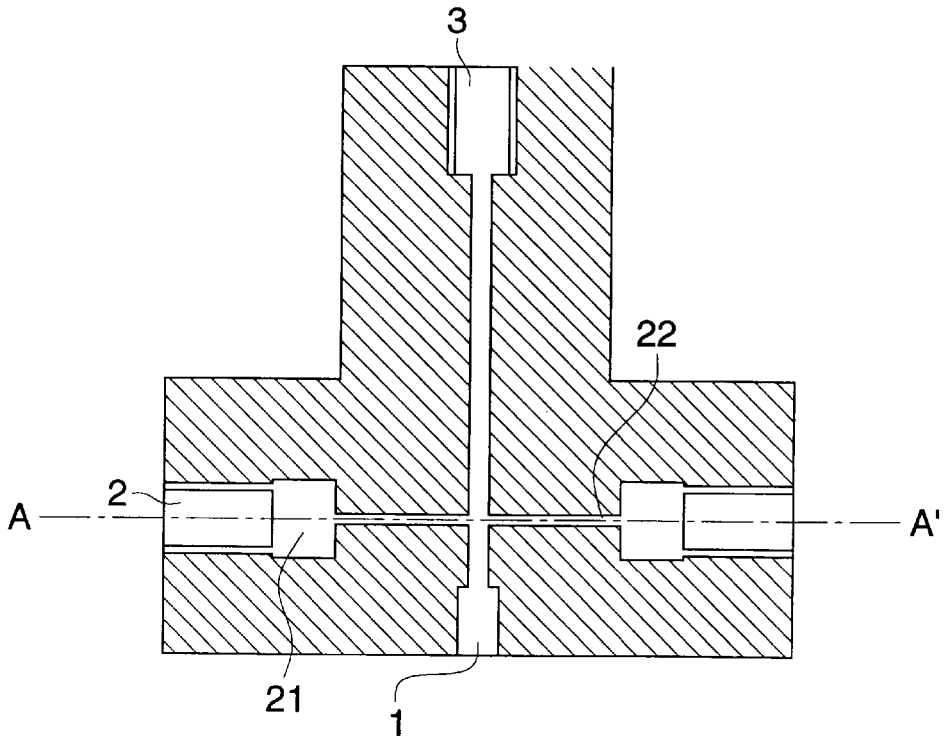
FIGS. 4*a* and 4*b* illustrate a sectional view of a mixing apparatus according to the present invention.
Figure 4B:
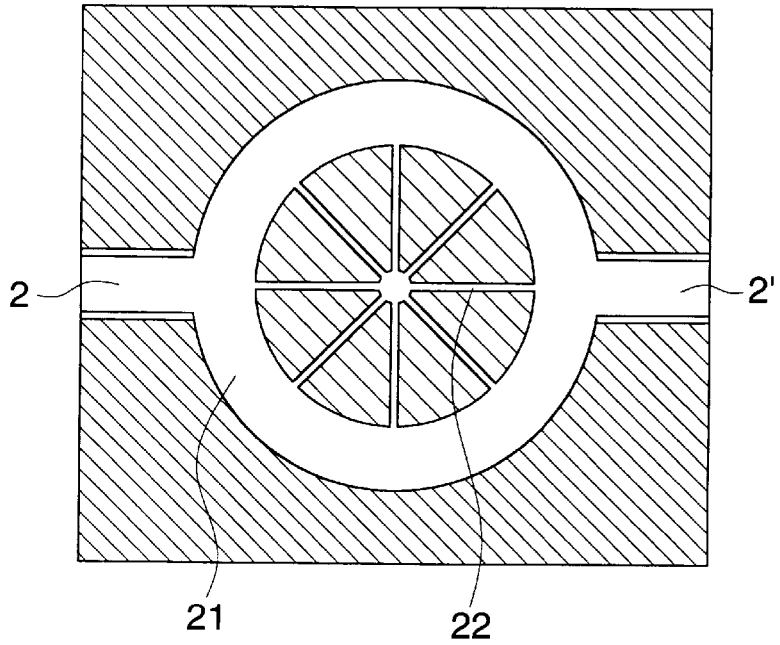
Figure 5:
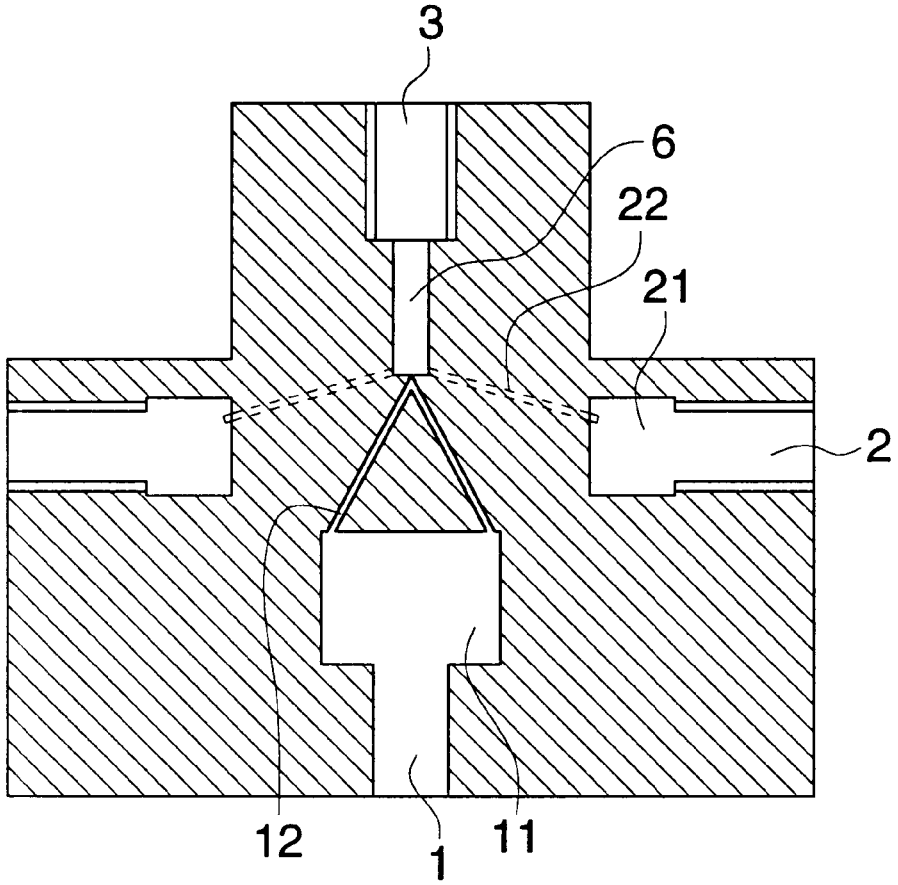
FIG. 5 illustrates a sectional view of a mixing apparatus according to the present invention.

The mixing apparatus used in the invention is characterized in that axes of the introduction tubes and the discharge tube all intersect at a single point, and no stirring mechanism is provided inside the tubes. The apparatus may be a T-type one as shown in FIG. 1 or a Y-type one as shown in FIGS. 2 and 3. As shown in FIGS. 4 and 5, it is also preferred to be comprised of plural conduits (or tubes) for introducing the silver salt solution or the halide solution. FIG. 4*a* shows a front sectional view and FIG. 4*b* shows a sectional view on line A—A' of FIG. 4*a,* in which the halide solution introduced from inlets 2 and 2' is retained once in a manifold 21, further introduced to introducing conduits 22, and then mixed uniformly with the silver salt solution, which is introduced from the inlet 1, to form nucleus grains. In a mixing apparatus as shown in FIG. 5, the silver salt solution is introduced from the inlet 1, retained in manifold 11, and then further introduced through introduction tube 12 to mixing section 6. In this case, halide introducing tube 22 is provided between the silver salt introducing tubes (12).

There may be mixed three or more kinds of solutions, for the purpose of using plural halide solutions or mixing together with a silver halide solvent, a grain growth retarder or a spectral sensitizing dye. The balance of the rate of introducing the silver salt solution and the halide solution may be the same or different. Specifically, in the step of grain growth, the silver salt solution and the halide solution may be introduced at a constant flow rate or may be added at varying rates in such a manner as to increase the flow rate, the supplying amount or the supplying concentration of the silver salt solution and/or halide solution.

Examples of the silver salt include silver nitrate and silver perchlorate, and silver nitrate is preferably employed. Examples of the halide include an alkali metal salt or ammonium salt of a chloride, bromide or iodide. Water is preferably employed as a solvent.

To the silver salt solution or the halide solution may be added a peptizer such as gelatin or an aqueous soluble polymer, or a surfactant. The peptizerl such as gelatin or an aqueous soluble polymer, or the surfactant is preferably added to the halide solution, and more preferably to the silver salt and halide solutions. Hydrophilic dispersing mediums known in the photographic art can be employed at the time of nucleation and gelatin is preferably used. Gelatin having a molecular weight of 90,000 to 300,000 is conventionally employed, and gelatin with a lower molecular weight may also be effectively employed. The concentration of the dispersing medium is preferably 0.05 to 5% by weight, and more preferably 0.05 to 2.0% by weight. Silver halide grains can be formed by either acidic precipitation, neutral precipitation or ammoniacal precipitation.

In the invention, mixing is not specifically limited within the apparatus, and substantially turbulent flow is preferred in terms of preventing back flow or homogeneous mixing. Turbulent flow is defined as based on the range of Reynolds number (hereinafter, also denoted as "Re"). As is well known, the Reynolds number is a dimensionless number and generally defined as below:

$$Re=DU\rho/\eta$$

where D is a characteristic length of a substance present in the fluid, U is a velocity, ρ is a density of fluid and η is the fluid viscosity. When the fluid flows through a tube (or a pipe), the characteristic length is assumed to be equal to the inner diameter of the tube, and in general, when Re<2,300, it is called laminar flow; when 2,300≦Re<3,000, it is called a transitional region; and when Re≧3,000, it is called turbulent flow. According to the invention, "substantially turbulent flow" refers to flow having a Reynolds number of more than 3,000, preferably more than 5,000 and more preferably, more than 10,000.

In the invention, the linear velocity is referred to as the velocity of a substance moving inside the tube (expressed in m/sec.), which corresponds to the velocity U of the Reynolds number described above. According to the invention, it is necessary that the Reynolds number is not only more than 3,000, but the linear velocity is also within a specified range. Thus, the linear velocity is preferably not less than 4 m/sec., more preferably not less than 5 m/sec., and still more preferably between 10 m/sec. and 100 m/sec. Although enhancements of the Reynolds number are known, nothing is known with respect to the effect achieved by setting the linear velocity within a specific range. Further, with regard to the relationship between the introduction tube and the discharge tube, the linear velocity of the introduction tube is preferably not less than 10 m/sec. and that of the discharge tube is preferably not less than 20 m/sec.

In the invention, the inner diameters of the plural introduction tubes are preferably nearly equal. Thus, assuming that the cross-section of the tube is circular, the difference in the inner diameter (or the cross-sectional area) between plural introduction tubes is preferably within 10%, and more preferably within 3%. In this case, the percentage of the difference is based on a silver salt introducing tube, expressed as $(D_2-D_1)/D_1\times100(\%)$, where $D_1$ is the inner diameter of a silver salt introducing tube and $D_2$ is that of a halide introducing tube. Furthermore, the inner diameters of the introduction tube and the discharge tube are preferably nearly equal. Thus, the difference in the inner diameter (or the cross-sectional area) between the introduction tube and the discharge tube is preferably within 10%, and more preferably within 3%. In this case, the percentage of the difference is also based on the silver salt introducing tube, expressed as $(D_3-D_1)/D_1\times100(\%)$, where $D_1$ is the inner diameter of a silver salt introducing tube and $D_2$ is that of the discharge tube.

The nucleus grains (nuclei) according to the invention are characterized in that the average grain size is not more than 0.05 μm. The grain size can be determined by allowing the nucleus grains contained in the emulsion to be put on a mesh and observing at least 1,000 grains by a transmission electron microscope. The grain size is the diameter of a circle having an area equivalent to a grain projected area, when projected in the direction vertical to the plane having the largest area among planes constituting the grain surface (also denoted as the major face), which is also denoted as the equivalent circular diameter. In the invention, the average grain size is preferably not more than 0.03 μm.

In the invention, the expression "substantially monodisperse" means a variation coefficient of grain size of not more than 20%. The variation coefficient is defined as (standard deviation of grain size/average grain size)×100 [%]. The variation coefficient of the grain size is preferably not more than 18%, and more preferably not more than 15%, and still more preferably not more than 15%.

At the initial stage of forming nucleus grains by mixing silver nitrate and halide solutions, slight fluctuation between flow rates of the silver nitrate and halide solutions results in marked variation in supersaturation, affecting the number of nucleus grains or the distribution of the twin plane number, which leads to variation in the grain size, distribution and aspect ratio of final grains. Accordingly, removal of non-stationary nucleus grains formed at the initial stage of mixing enables stable nucleation and makes it feasible to stably prepare a silver halide emulsion with negligible batch fluctuation. When forming nucleus grains by the use of the mixing apparatus according to the invention, the silver potential is continuously measured during the nucleation, and when the variation thereof reaches 2.0 mV or less, the nucleus grains formed thereafter are preferably employed. Furthermore, preferably when the variation thereof reaches 1.0 mV or less (and more preferably, 0.5 mV or less), the nucleus grains formed thereafter are employed.

The amount of silver at the time of the nucleus grains being formed by mixing a silver salt solution and a halide solution, which affects homogeneity of the grain size distribution, is preferably not more than 0.01 mol/l, more preferably not more than 0.008 mol/l, and still more preferably not more than 0.005 mol/l. Accordingly, the molar concentration of the silver salt solution is preferably not more than 0.01 mol/l; the difference in the molar concentration between the silver salt solution and the halide solution is preferably not more than 10%, and more preferably not more than 3%. In this case, the percentage of the difference is based on the silver salt solution, expressed as $(C_2-C_1)/C_1\times100(\%)$, where $C_1$ and $C_2$ are the concentration of the silver salt solution and the halide solution, respectively. Furthermore, the concentration of the silver salt solution is preferably higher than that of the halide solution.

A pump used in the nucleus grain formation by mixing the silver salt and halide solutions is desirably one with pulsating flow as small as possible. As is well known, the pulsating flow is irregular fluid flow in a piping system, in which the flow rate periodically varies without change of its direction. It is often resulted from the pressure variations of the pump in the system. The pulsation of the pump periodically varies the supersaturation in the area where the silver salt and halide solutions are mixed, forming non-homogeneous nucleus grains. This causes formation of multiple non-parallel twinned crystal grains, reducing the degree of total final grain dispersity. Accordingly, the pulsating flow of the pump is preferably not more than 2% of the average flow rate, more preferably not more than 1.0%, and still more preferably not more than 0.5%. In this case, the percentage of the pulsating flow is defined as $(F_{max}-F_{min})/F_{av}\times100(\%)$, where $F_{max}$, $F_{min}$ and $F_{av}$ are the maximum flow rate, the minimum flow rate and the average flow rate, respectively.

In the invention, low solubility of silver halide is preferable at the time of nucleation. Accordingly, the temperature at nucleation is preferably not higher than 50° C., more preferably not higher than 40° C., and still more preferably between 10 and 30° C. The pH at nucleation is preferably 1 to 7, more preferably between 1 and 5, and still more preferably between 1 and 3. The pBr is preferably not more than 2.5, and more preferably not more than 2.3.

The nucleus grains prepared according to the invention may be comprised of silver iodide, silver iodobromide, silver bromide, silver chlorobromide, silver iodochloride or silver iodochlorobromide.

The silver halide nucleus grains obtained in the invention may be applied to a photographic material or employed as a silver halide source for grain growth or seed crystal grains for growing tabular grains. In cases when employed as the seed grains for the tabular grains, the nucleus grains are further subjected to the following process (i.e., ripening step and growing step) to form the tabular grains.

Ripening Step

According to the foregoing process, tabular nucleus grains are formed, and formed at the same time may also be other fine grains, such as fine octahedral grains or single twinned crystal grains. Prior to the growth step described below, it is preferred to allow these fine grains other than the tabular nucleus grains to be disappeared to obtain monodispersed tabular seed grains. This can be made by the foregoing nucleation, followed by Ostwald ripening, as is well known in the art. Silver halide solvents are preferably employed to accelerate the ripening. Examples of silver halide solvents include thiocyanate, ammonia, ammonium salts, thioethers and thioureas. The silver halide solvent is employed preferably in an amount of not less than $10^{-4}$ mol/l, more preferably not less than $10^{-3}$ mol/l, and still more preferably not less than $10^{-2}$ mol/l.

Growing Step

An emulsion comprised of tabular silver halide grains can be obtained by further supplying soluble silver salt and soluble halide solutions, or a fine silver halide grain emulsion to the silver halide emulsion ripened as above.

The tabular silver halide grains according to the invention are those having a twin plane, or two or more parallel twin planes within the grain. Specifically to reduce fluctuation in grain size, grains having two parallel twin planes are preferred.

The silver halide grains which are prepared using the nucleus grains as seed grains, will now be described. The aspect ratio refers to the ratio of a grain diameter to the grain thickness (diameter/thickness). The grain diameter is referred to as the diameter of a circle having an area equivalent to a grain projected area when projected in the direction vertical to the plane having the largest area among planes constituting the grain surface (also denoted as a major face), which is also denoted as an equivalent circular diameter. The grain thickness is the thickness in the direction vertical to the major face, and in general, is the distance between two major faces.

The grain diameter and thickness can be determined in the following manner. Together with latex balls with a known diameter as an internal standard were coated on a support silver halide grains so as to allow the major faces to be parallel to the support. After subjecting the thus prepared sample to shadowing by carbon vacuum evaporation from a given angle, a replica sample is prepared by the conventional replica method. The grain diameter and thickness can be determined using electron micrograph of the replica sample and an image processing apparatus. In this case, the grain thickness can be determined from the internal standard and the shadow length of the grain. The average aspect ratio can be determined by optionally selecting 300 or more silver halide grains and observing their aspect ratio. The silver halide emulsion according to the invention is comprised of tabular grains having an average aspect ratio of preferably not less than 5, and more preferably not less than 7. The average size of the tabular grains is preferably not less than 0.6 $\mu$m, and more preferably not less than 1.0 $\mu$m.

The silver halide grains according to the invention preferably comprise silver iodobromide or silver iodochlorobromide, and more preferably silver iodobromide. The average iodide content is preferably 10 mol % or less, more preferably 8 mol % or less, and still more preferably 5 mol % or less. The halide composition of silver halide grains can be determined by the EPMA method or the X-ray diffraction method. In the silver halide emulsion relating to the invention, the iodide content is preferably uniform among grains. Thus, a variation coefficient of iodide content among the grains is preferably 30% or less, and more preferably 20% or less. The variation coefficient of iodide content among the grains is defined as the standard deviation of the iodide content of grains divided by the average iodide content times 100(%); and at least 500 grains are randomly selected from the emulsion.

To accurately control the iodide content within the grain or among the grains, at least a part of the iodide containing phase of the silver halide grain is formed preferably in the presence of iodide-containing silver halide grain having a lower solubility. The less soluble silver halide grains are preferably silver iodide. The iodide containing phase can also be formed by supplying one or more kinds of fine silver halide grains.

The silver halide grains relating to the invention preferably contain dislocation lines within the grain. The preferred location of the dislocation lines is in the vicinity of peripheral portions, edges or corners of the tabular grains. The dislocation lines are introduced preferably after 50% of the total silver, and more preferably between 60% and 85%. Silver halide grains containing 5 or more dislocation lines account for, preferably at least 30%, more preferably at least 50%, and still more preferably at least 80% of the total number of the grains.

The dislocation lines in the tabular grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. Silver halide tabular grains are taken out from an emulsion while making sure to not exert any pressure which causes dislocation in the grains, and they are then placed on a mesh for electron microscopy. The sample is observed by transmission electron microscopy, while being cooled to prevent the grain from being damaged (e.g., printing-out) by electron beam. Since electron beam penetration is hampered as the grain thickness increases, sharper observations are obtained when using an electron microscope of high a voltage type. From the thus-obtained electron micrograph can be determined the position and number of the dislocation lines in each grain.

Optional is a method for introducing the dislocation lines into the silver halide grain. The dislocation lines can be introduced by various methods, in which, at the desired position of introducing the dislocation lines during the course of forming silver halide grains, an iodide (e.g., potassium iodide) aqueous solution is added, along with a silver salt (e.g., silver nitrate) solution, and without addition of a halide other than iodide by a double jet technique, silver iodide fine grains are added, only an iodide solution is added, or a compound capable of releasing an iodide ion disclosed in JP-A 6-11781 (1994) is employed. Among these, it is preferable to add iodide and silver salt solutions by a double jet technique, or to add fine silver iodide grains or an iodide ion releasing compound, as an iodide source.

During the nucleation or growth of the grains there may be added a metal ion selected from cadmium salts, zinc salts, lead salts, thallium salts, iridium salts (including its complex salts), indium salts, rhodium salts (including its complex salts) and iron salts (including its complex salts). These ions may be allowed to be contained in the interior or surface of the grain. Reduction sensitization nuclei may be provided in the interior or surface of the grains by subjecting them to a reducing environment.

A tabular grain emulsion used in the invention, after completing growth of the tabular grains, can be desalted to remove soluble salts. Desalting is conducted using the method described in Research Disclosure (hereinafter, denoted as "RD") 17643, section II. More concretely, to remove soluble salts from an emulsion after completion of grain formation or physical ripening, there may be employed a noodle washing method in which a gelatin solution is gelled, and flocculation method in which inorganic salts, anionic surfactants, anionic polymers (e.g. polystyrene sulfonic acid), gelatin derivatives (e.g. acylated gelatin, carbamoyl gelatin) are employed.

Tabular grains used in the invention can be chemically sensitized by any of several conventional methods. Thus, sulfur sensitization, selenium sensitization or noble metal sensitization with gold or other noble metals may be employed singly or in combination thereof.

The tabular grains can also be optically sensitized to a desired wavelength region using a sensitizing dye known in the photographic art. The sensitizing dye can be employed singly or in combinations. There may be incorporated, along with the sensitizing dye, a dye having no spectral sensitizing ability or a supersensitizer which does not substantially absorb visible light and enhances sensitization of the dye.

An antifoggant and stabilizer can also be added into the tabular grain emulsion. Gelatin is advantageously employed as a binder. An emulsion layer or other hydrophilic colloid layers can be hardened with hardeners. A plasticizer or a dispersion of a water-soluble or water-insoluble polymer (so-called latex) can also be incorporated.

In a silver halide emulsion layer of a photographic material, a coupler can be employed. There can also be employed a competing coupler having an effect of color correction and a compound which, upon coupling reaction with an oxidation product of a developing agent, is capable of releasing a photographically useful fragment, such as a developing accelerator, a developing agent, a silver halide solvent, a toning agent, a hardener, a fogging agent, a chemical sensitizer, a spectral sensitizer or a desensitizer.

A filter layer, an anti-halation layer or an anti-irradiation layer can be provided in the photographic material relating to the invention. In these layers and/or an emulsion layer, a dye which is leachable out of a processed photographic material or bleachable during processing, can be incorporated. Furthermore, a matting agent, a lubricant, an image stabilizer, a formalin scavenger, a UV absorbent, a brightening agent, a surfactant, a development accelerator or development retarder my also be incorporated into the photographic material. Employed may be, as a support, polyethylene-laminated paper, polyethylene terephthalate film, baryta paper or cellulose triacetate film.

EXAMPLES

Embodiments of the present invention will be explained based on examples, but the invention is not limited to these examples.

Example 1

Preparation of Emulsion 1-1

Nucleation

A gelatin solution B-101 was maintained at 30° C. in a reaction vessel while stirring at 400 r.p.m. by use of a stirring mixer described in JP-A 62-160128, the pH was adjusted to 1.96 with a 1N sulfuric acid solution, and thereto were added solutions S-101 and X-101 for 1 min. by the double jet addition to form nucleus grains.

| | |
|---|---|
| B-101 | |
| Low molecular weight gelatin (Av. M.W. 20,000) | 3.24 g |
| Potassium bromide | 0.992 g |
| $H_2O$ | 1293.8 ml |
| S-101 | |
| Silver nitrate | 5.043 g |
| $H_2O$ | 22.59 ml |
| X-101 | |
| Potassium bromide | 3.533 g |
| $H_2O$ | 22.47 ml |

Ripening

After completing the addition, the following solution G-101 was added and the temperature was raised to 60° C. in 30 min., then the pH was adjusted to 5.8 with a 1N potassium hydroxide solution and mixing was maintained further for 20 min, while keeping the silver potential of 6 mV (measured with a silver ion selection electrode versus a saturated silver-silver chloride electrode, as a reference electrode) using a 1N potassium bromide solution.

| | |
|---|---|
| G-101 | |
| Alkali-processed inert gelatin (Av. M.W. 100,000) | 13.91 g |
| $HO(CH_2CH_2O)_m[CH(CH_3)CH_2O]_{19.8}(CH_2CH_2O)_NH$ (m + n = 9.77) (10 wt. % methanol solution) | 0.464 ml |
| $H_2O$ | 326.6 ml |

Growth

After completion of the ripening, 1.25N silver nitrate aqueous solution and 1.25N potassium bromide aqueous solution were added by the double jet addition at an accelerated flow rate until reached an average final grain size (cubic equivalent length) of 0.65 $\mu$m.

After completing the growth, the emulsion was desalted according to a conventional manner; thereafter, gelatin was added thereto to redisperse the emulsion; and then the pH and pAg were adjusted to 5.8 and 8.1, respectively. The thus prepared emulsion was denoted as comparative emulsion 1-1. The emulsion was measured with respect to the grain size and aspect ratio by the replica method:

| | |
|---|---|
| average circular equivalent diameter | 1.38 $\mu$m |
| average aspect ratio | 7.4 |
| variation coefficient of grain size | 25.3%. |

Preparation of Emulsion 1-2

Figure 2:
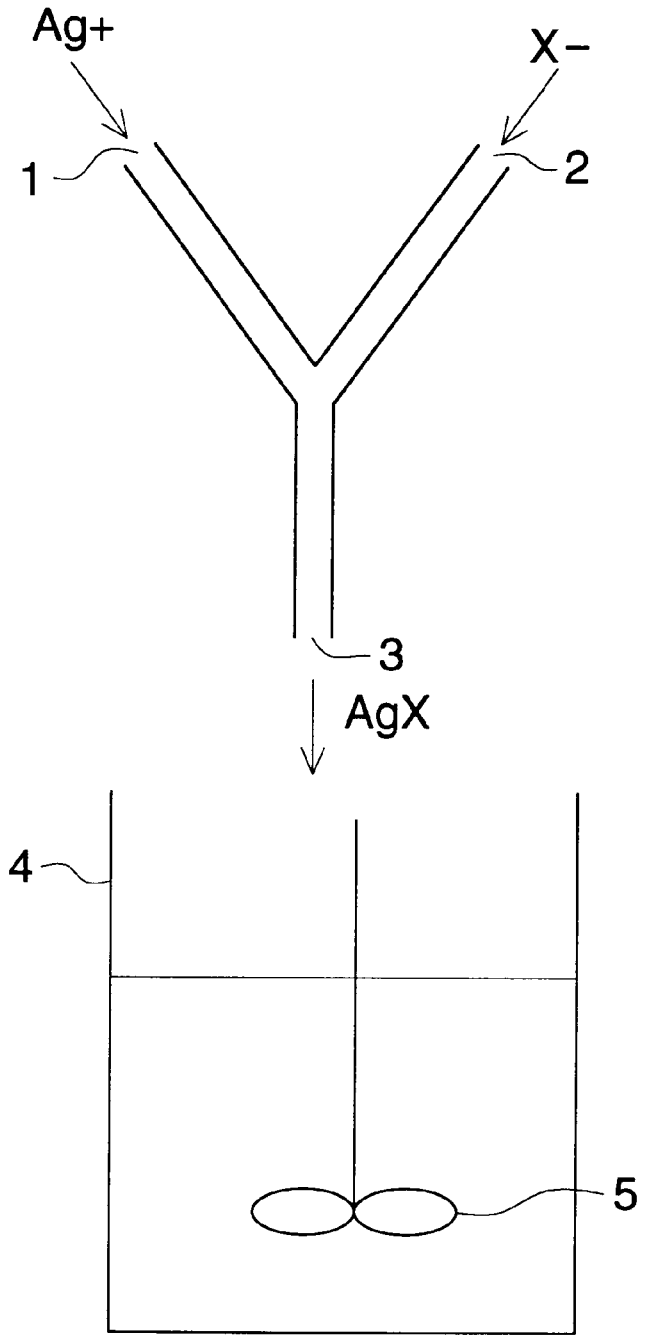

The following silver salt solution (S-201) and halide solution (X-201) each were introduced at a constant flow rate, using a nucleus grain forming apparatus as shown in FIG. 2 and at a Reynolds number and a linear velocity as shown in Table 1 (in which the inner diameter of the inlet and outlet of the silver salt and halide solutions were each 1 mm) to form nucleus grains, provided that a gelatin aqueous solution B-101 and sulfuric acid for pH adjustment used in the preparation of Emulsion 1-1 were distributed to solutions S-201 and X-201.

| B-101 | |
|---|---|
| Low molecular weight gelatin (Av. M.W. 20,000) | 3.24 g |
| Potassium bromide | 0.992 g |
| $H_2O$ | 1293.8 g |
| S-201 | |
| Silver nitrate | 5.043 g |
| 1/10 N sulfuric acid | 3.90 ml |
| $H_2O$ | 670.87 ml |
| X-201 | |
| Low molecular weight gelatin (Av. M.W. 100,000) | 3.24 g |
| Potassium bromide | 4.525 g |
| 1/10 N sulfuric acid | 3.90 ml |
| $H_2O$ | 667.98 ml |

Ripening

To a mixing vessel containing solution G-101 at 30° C. used in Emulsion 1-1 was continuously added the nucleus grain emulsion, raised to 60° C. in 60 min. and then ripened in a manner similar to Emulsion 1-1.

Growth

After completion of ripening, emulsion grains were further grown in a manner similar to Emulsion 1-1 to obtain Emulsion 1-2.

The emulsion was measured with respect to the grain size and aspect ratio by the replica method:

| | |
|---|---|
| average circular equivalent diameter | 1.37 μm |
| average aspect ratio | 7.3 |
| variation coefficient of grain size | 12.9%. |

Preparation of Emulsion 1-3

Emulsion 1-3 was prepared in the same manner as Emulsion 1-2, except that the silver salt and halide solutions were added at a constant flow rate, using a nucleus grain forming apparatus as shown in FIG. 5 and at a Reynolds number and a linear velocity as shown in Table 1 (in which the inner diameter of the inlet and outlet of the silver salt and halide solutions were each 1 mm).

The emulsion was measured with respect to the grain size and aspect ratio by the replica method:

| | |
|---|---|
| average circular equivalent diameter | 1.35 μm |
| average aspect ratio | 7.0 |
| variation coefficient of grain size | 9.2%. |

As can be seen from the foregoing, it was proved that tabular silver halide grains which were prepared by the use of the apparatus according to the invention, exhibited markedly enhanced homogeneity of the grain size distribution.

Example 2

Preparation of Emulsion 2-1

Two solutions having the same composition as Solutions S-201 and X-201, each of 2,000 ml, were mixed at a flow rate, using a nucleus grain forming apparatus as shown in FIG. 2 and at a Reynolds number and a linear velocity as shown in Table 1 (in which the inner diameter of the inlet and outlet of the silver salt and halide solutions was each 1 mm) to form a nucleus grain emulsion. The nucleus grain emulsion of 1,200 ml, which was formed immediately after starting mixing, was employed in the subsequent ripening and growing stage. In this case, the silver potential was continuously measured and variation thereof was 2.8 mV. Using this nucleus grain emulsion, ripening and growing were carried out in a manner similar to Emulsion 1-2 to obtain Emulsion 2-1.

The emulsion was measured with respect to the grain size and aspect ratio by the replica method:

| | |
|---|---|
| average circular equivalent diameter | 1.41 μm |
| average aspect ratio | 7.9 |
| variation coefficient of grain size | 19.3%. |

Preparation of Emulsion 2-2

Two solutions having the same composition as Solutions S-201 and X-201, each of 2,000 ml, were mixed at a flow rate, using a nucleus grain forming apparatus as shown in FIG. 2 and at a Reynolds number and a linear velocity as shown in Table 1 (in which the inner diameter of the inlet and outlet of the silver salt and halide solutions was each 1 mm) to form a nucleus grain emulsion. In this case, the silver potential was continuously measured. The nucleus grain emulsion of 1,200 ml, which was formed after variation of the silver potential reached 2.0 mV or less, was employed in the subsequent ripening and growing stage. Using this nucleus grain emulsion, ripening and growing were carried out in a manner similar to Emulsion 1-2 to obtain Emulsion 2-2.

The emulsion was measured with respect to the grain size and aspect ratio by the replica method:

| | |
|---|---|
| average circular equivalent diameter | 1.39 μm |
| average aspect ratio | 7.7 |
| variation coefficient of grain size | 11.7%. |

As can be seen from the foregoing results, it was proved that the use of the nucleus grain emulsion, which was formed after variation of the silver potential reached 2.0 mV or less, led to improved homogeneity of the grain size distribution. Furthermore, the method used in Emulsion 2-2 was also proved to result in reduced batch fluctuation in the grain size, aspect ratio and variation coefficient.

Example 3

Preparation of Emulsion 3-1

The following solution S-202 and X-2-2 were each added at a constant flow rate through the nucleus grain forming apparatus as shown in FIG. 2 and at a Reynolds number and a linear velocity as shown in Table 1 (in which the inner diameter of the inlet and outlet of the silver salt and halide solutions was each 1 mm) to form a nucleus grain emulsion.

| S-202 | |
|---|---|
| Silver nitrate | 4.097 g |
| 1/10 N sulfuric acid | 3.90 ml |
| $H_2O$ | 670.87 ml |
| X-202 | |
| Low molecular weight gelatin (Av. M.W. 100,000) | 3.24 g |
| Potassium bromide | 2.873 g |
| 1/10 N sulfuric acid | 3.90 ml |
| $H_2O$ | 668.35 ml |

Using the nucleus grain emulsion, ripening and growing were carried out in a manner similar to Emulsion 1-2 to obtain Emulsion 3-1.

The emulsion was measured with respect to the grain size and aspect ratio by the replica method:

| | |
|---|---|
| average circular equivalent diameter | 1.36 μm |
| average aspect ratio | 7.1 |
| variation coefficient of grain size | 10.8%. |

As can be seen from the foregoing results, tabular silver halide grains, which were prepared by the method according to the invention, exhibited superior homogeneity of the grain size distribution.

Example 4

Preparation of Emulsion 4-1

Emulsion 4-1 was prepared in the same manner as Emulsion 1-2, except that a nucleus grain formation was carried out at a constant flow rate through the mixing apparatus as shown in FIG. 3, and at a Reynolds number and a linear velocity as shown in Table 1 (in which the inner diameter of the inlet and outlet of the silver salt and halide solutions were each 1 mm), using a commercial roller pump. From the result of measurement, the pulsating flow of the roller pump was ±5.3% of the average flow rate.

The emulsion was measured with respect to the grain size and aspect ratio by the replica method:

| | |
|---|---|
| average circular equivalent diameter | 1.38 μm |
| average aspect ratio | 7.5 |
| variation coefficient of grain size | 17.6%. |

Preparation of Emulsion 4-2

Emulsion 4-2 was prepared in the same manner as Emulsion 1-2, except that the nucleus grain formation was carried out at a constant flow rate through the mixing apparatus as shown in FIG. 3 and at a Reynolds number and a linear velocity as shown in Table 1 (in which the inner diameter of the inlet and outlet of the silver salt and halide solutions was each 1 mm), using a plunger pump (available from Fuji Tekuno-Kogyo Co., Ltd.). The pulsating flow of the plunger pump was ±1.1% of the average flow rate.

The emulsion was measured with respect to the grain size and aspect ratio by the replica method:

| | |
|---|---|
| average circular equivalent diameter | 1.34 μm |
| average aspect ratio | 6.9 |
| variation coefficient of grain size | 11.3%. |

As can be seen from the foregoing results, it was proved that the use of the pump with reduced pulsating flow led to improved grain size homogeneity of the silver halide tabular grain emulsion. Furthermore, the method used in Emulsion 4-2 was also proved to result in reduced batch fluctuation in grain size, aspect ratio and variation coefficient.

Example 5

Preparation of Emulsion 5-1

Emulsion 5-1 was prepared in a manner similar to Emulsion 1-2, provided that the inner diameter of the inlet and outlet of the silver salt and halide solutions of the nucleus grain forming apparatus were each changed to 3 mm.

The emulsion was measured with respect to the grain size and aspect ratio by the replica method:

| | |
|---|---|
| average circular equivalent diameter | 1.36 μm |
| average aspect ratio | 7.3 |
| variation coefficient of grain size | 23.7%. |

Results of Examples 1 through 5 are summarized in Table 1, as shown below.

TABLE 1

| Emul- | Rey- | Linear | Nucleus grain Emulsion | | | Final grain emulsion | | | |
|---|---|---|---|---|---|---|---|---|---|
| sion No. | nolds No. | velocity (in/sec) | Twin crystal (%)*1 | Av. grain size (μm) | V.C. (%)*2 | Av. grain size (μm) | V.C. (%)*3 | Av. aspect ratio | Remark |
| 1-1 | — | — | 8 | 0.05 | 21 | 1.38 | 25.3 | 7.4 | Comp |
| 1-2 | 15,810 | 12.5 | 87 | 0.02 | 9 | 1.37 | 12.9 | 7.3 | Inv. |
| 1-3 | 31,619 | 25.0 | 91 | 0.02 | 5 | 1.35 | 9.2 | 7.0 | Inv. |
| 2-1 | 15,810 | 12.5 | 52 | 0.05 | 20 | 1.41 | 19.3 | 7.9 | Inv. |
| 2-2 | 15,810 | 12.5 | 87 | 0.02 | 9 | 1.39 | 11.7 | 7.7 | Inv. |
| 3-1 | 15,810 | 12.5 | 89 | 0.02 | 8 | 1.36 | 10.8 | 7.1 | Inv. |
| 4-1 | 15,810 | 12.5 | 68 | 0.04 | 15 | 1.38 | 17.6 | 7.5 | Inv. |
| 4-2 | 15,810 | 12.5 | 90 | 0.02 | 6 | 1.34 | 11.3 | 6.9 | Inv. |
| 5-1 | 13,175 | 3.5 | 15 | 0.05 | 27 | 1.36 | 23.7 | 7.3 | Comp. |

*1: Percentage of twin crystal grains having two parallel twin planes
*2: Variation coefficient of grain size
*3 Variation coefficient of grain size As can be seen, according to the invention were obtained tabular grain emulsions, which were superior in homogeneity in the grain size distribution.

What is claimed is:

1. A method for preparing a silver halide emulsion, comprising:

introducing a silver salt solution and a halide solution through separate introduction tubes, said silver salt solution containing a maximum of 0.01 mol per liter of a silver salt, mixing the silver salt and halide solutions to react a silver salt and a halide to form silver halide grains, discharging a reaction mixture solution through a discharge conduit and using a mixing apparatus in which the introduction tubes and the discharge conduit are linked together so that all center axes of the introduction tubes and discharge conduit intersect at a single point, wherein the silver salt solution and the halide solution are independently introduced at a linear velocity of not less than 4.0 m/sec and a Reynolds number of not less than 3,000.

2. The method of claim 1, wherein the Reynolds number is not less than 10,000.

3. The method of claim 1, wherein the linear velocity is not less than 5.0 m/sec.

4. The method claim 1, wherein the silver salt solution and the halide solution are independently introduced at a linear velocity of not less than 10.0 m/sec and the reaction mixture solution is discharged at a linear velocity of not less than 20 m/sec.

5. The method of claim 1, wherein a difference in an inner diameter between the introduction tubes is not more than 10%.

6. The method of claim 1, wherein a difference in an inner diameter between the introduction tubes and the discharge conduit is not more than 10%.

7. The method of claim 1, wherein a difference in a molar concentration between the silver salt solution and the halide solution is not more than 10%.

8. The method of claim 1, wherein the silver salt solution and the halide solution are each introduced through the introduction tubes by the use of a pump having a pulsating flow within ±2% of the average flow rate.

9. The method of claim 1, wherein the silver halide grains formed have an average grain size of not more than 0.05 $\mu$m and a variation coefficient of grain size of not more than 20%, and at least 50% of the total number of the silver halide grains formed being accounted for by tabular grains having two parallel twin planes.

10. The method of claim 1, wherein the silver halide grains formed are discharged through the discharge conduit and then introduced into a reaction vessel to allow the silver halide grains to grow therein, and wherein the silver potential in the discharge conduit is continuously measured and after variation of the silver potential reaches 2.0 mV or less, the silver halide grains which are discharged from the discharge conduit, are introduced into the reaction vessel.

11. The method of claim 10, wherein at least 50% of the total projected area of the silver halide grains which have been grown in the reaction vessel is accounted for by monodisperse tabular grains having an aspect ratio of not less than 5, an average grain diameter of not less than 0.6 $\mu$m and a variation coefficient of grain size of not more than 20%.

* * * * *